US008683622B2

(12) United States Patent
Ciechanowski et al.

(10) Patent No.: US 8,683,622 B2
(45) Date of Patent: Apr. 1, 2014

(54) DRAIN SYSTEM FOR BATHTUB WITH DOOR

(75) Inventors: Dominique Ciechanowski, Ste-Marguerite-de-Dorchester (CA); Miguel Castellote, Ste-Marguerite-de-Dorchester (CA); Jonathan Castellote-Ciechanowski, Ste-Marguerite-de-Dorchester (CA)

(73) Assignee: C.G. Air Systemes Inc., Sainte-Marguerite-de-Dorchester ( * ) Notice: Subject to any disclaimer, the term of this patent is extended or adjusted under 35 U.S.C. 154(b) by 181 days.

(21) Appl. No.: 13/456,642

(22) Filed: Apr. 26, 2012

(65) Prior Publication Data

US 2013/0283518 A1 Oct. 31, 2013

(51) Int. Cl.
*A47K 3/02* (2006.01)

(52) U.S. Cl.
USPC ..... 4/555; 4/556

(58) Field of Classification Search
USPC ..... 4/555–557, 607
See application file for complete search history.

(56) References Cited

U.S. PATENT DOCUMENTS 5,184,358 A * 2/1993 Gruidel et al. ..... 4/555

FOREIGN PATENT DOCUMENTS

CA 2195026 7/1998

* cited by examiner

*Primary Examiner* — Tuan N Nguyen
(74) *Attorney, Agent, or Firm* — Norton Rose Fulbright Canada LLP

(57) ABSTRACT

A drain system for a tub of the type having a tub body defining a bathing cavity, a doorway with door sill in the tub body and a door in the doorway. The drain system comprises a drain piping section adapted to be in fluid communication with a tub drain hole in a bottom of the bathing cavity for drainage of bathing liquid therethrough. A drain unit is adapted to be connected to a door drain hole in the door sill for drainage of liquid therethrough. The drain unit has an inner cavity and a check valve held releasably captive in the inner cavity. The check valve is manually removable from an exposed surface of the door sill. A pipe connects the drain unit to the drain piping section to direct liquid collected by the drain unit to the drain piping section.

20 Claims, 5 Drawing Sheets

DRAIN SYSTEM FOR BATHTUB WITH DOOR

CROSS-REFERENCE TO RELATED APPLICATION(S)

The present application claims priority on U.S. Provisional Patent Application No. 61/478,071, filed Apr. 26, 2011, and incorporated herein by reference.

FIELD OF THE APPLICATION

The present application generally relates to drain systems for bathtubs, and more particularly bathtubs of the type having doors (i.e., walk-in bathtub) to provide an access to an interior of the bathtub.

FIELD OF THE APPLICATION

The present application generally relates to drain systems for bathtubs, and more particularly bathtubs of the type having doors (i.e., walk-in bathtub) to provide an access to an interior of the bathtub.

BACKGROUND OF THE ART

Bathtubs with doors are an increasingly common occurrence in households. They are used to facilitate entrance into the tub for the physically challenged, such as elderly and/or disabled users. Accordingly, such users do not need to step over the bathtub wall to enter the tub.

However, one concern with the presence of waters in tubs is the fact that a joint is formed between the door and a remainder of the door, which joint could be a pathway for water leakage. Therefore, all necessary measures must be taken to prevent water damages because of water leaking through the door.

SUMMARY OF THE APPLICATION

It is therefore an aim of the present disclosure to provide a novel drainage system for tubs with doors.

Therefore, in accordance with an embodiment of the present application, there is provided a tub comprising: a tub body defining a bathing cavity, and a doorway with door sill in the tub body; a door mounted to the doorway and openable to access the bathing cavity; a drain system comprising drain piping connected to a tub drain hole in a bottom of the bathing cavity for drainage of bathing liquid therethrough; a drain unit connected to a door drain hole in the door sill for drainage of liquid therethrough, the drain unit having an inner cavity and a check valve held releasably captive in the inner cavity, the check valve being manually removable from an exposed surface of the door sill; and a pipe connecting the drain unit to the drain piping to direct liquid collected by the drain unit to the drain piping.

In accordance with another embodiment of the present disclosure, there is provided a drain system for a tub of the type having a tub body defining a bathing cavity, a doorway with door sill in the tub body and a door in the doorway, the drain system comprising: a drain piping section adapted to be in fluid communication with a tub drain hole in a bottom of the bathing cavity for drainage of bathing liquid therethrough; a drain unit adapted to be connected to a door drain hole in the door sill for drainage of liquid therethrough, the drain unit having an inner cavity and a check valve held releasably captive in the inner cavity, the check valve being manually removable from an exposed surface of the door sill; and a pipe connecting the drain unit to the drain piping section to direct liquid collected by the drain unit to the drain piping section.

DESCRIPTION OF THE PREFERRED EMBODIMENTS

Figure 1:
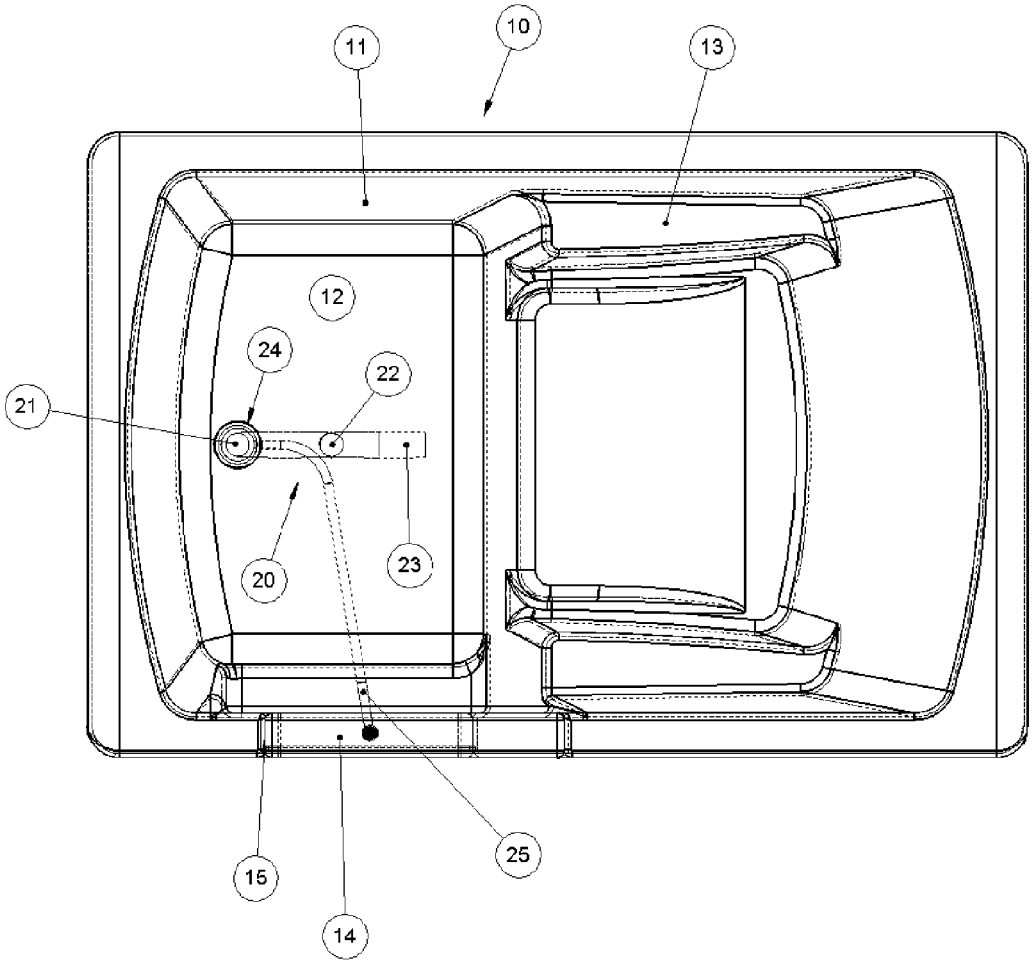
FIG. 1 is a top plan view of a tub with a door, the tub having the drain system of the present disclosure.
Figure 2:
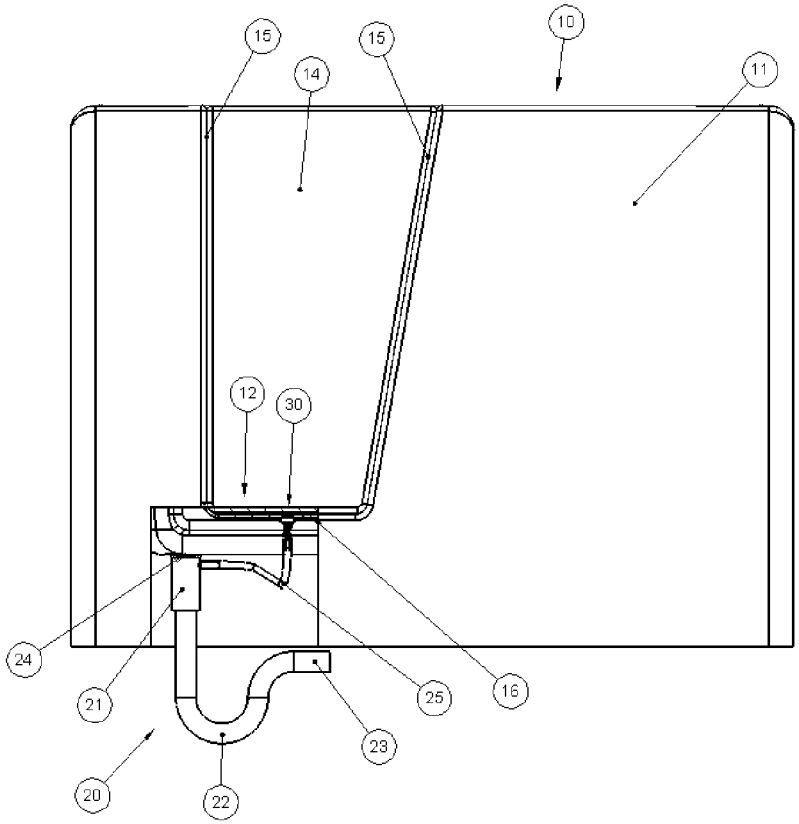
FIG. 2 is a section view of the tub of FIG. 1.

Referring to the drawings, and more particularly to FIGS. 1 and 2, there is illustrated a tub 10 of the type that may be used with the drain system of the present disclosure.

The tub 10 has a peripheral wall 11 defining the periphery of the tub 10, and a bottom wall 12 defining with an inner exposed surface of the peripheral wall 11 the bottom of the bathing cavity 13. As shown in FIG. 1, a seat and arm rests may be formed in the bathing cavity 13. The peripheral wall and the bottom wall 12 are made of any appropriate material used for tubs, such as polymeric materials, fiberglass, metal, etc. The peripheral wall 11 is referred to as a single wall, but may consist of a pair of spaced apart walls defining a hollow hidden cavity on the hidden/inner side of the tub. The tub 10 has an underside that comprises a hidden surface (i.e., not visible when the tub 10 is installed), the hidden surface being that of both the peripheral wall 11 and the bottom wall 12. Any appropriate construction for the peripheral wall 11 is considered.

A door 14 is hinged to the peripheral wall 11 and may open inward or outward of the bathing cavity 13. The door 14 is mounted to a doorway defined in the peripheral wall 11, and bound by door jambs 15 and door sill 16. The door 14 must sealingly engage the periphery of the doorway, i.e., the door jambs 15 and the door sill 16, so as to prevent any leakage of water when the bathing cavity 13 is filled with liquid. Appropriate seals, gaskets, etc may be used, in addition to the precise fitting of the door 14 into the doorway. However, these components are not illustrated and will not be described for simplicity purposes.

The door jambs 15 and door sill 16 may be sloped to direct residual liquid toward the bathing cavity 13, with some of the liquid gathered on the door jambs 15 dripping by the effect of gravity toward the door sill 16.

Figure 4:
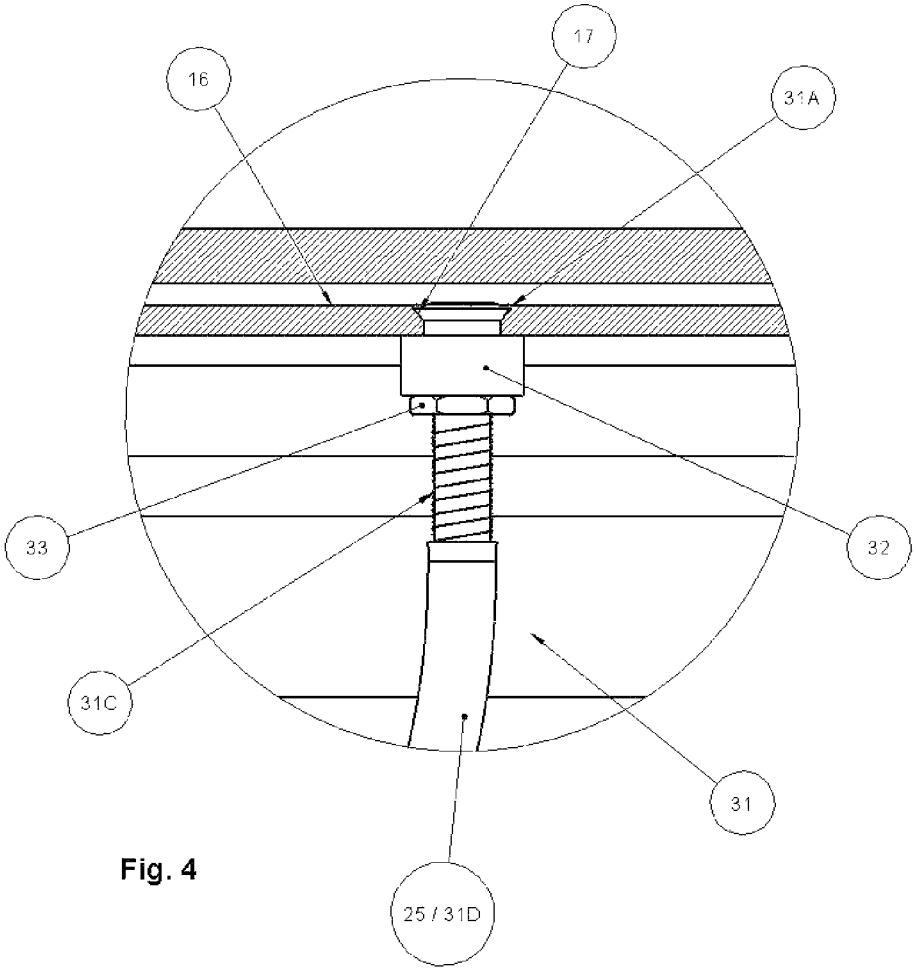
FIG. 4 is a section view of the drain unit of FIG. 3 mounted to a door sill.

As seen in FIGS. 1, 2 and 4, a drain hole 17 is defined in the wall of the door sill 16, by which a drain system 20 of the present disclosure will drain residual water collected from the door sill 16 (i.e., residual water referring to droplets on the surfaces of the tub). Referring to FIGS. 1 and 2, the drain system 20 is illustrated relative to the tub 10. The drain system 20 features a drain pipe section 21 connected to a drain hole in the bottom wall 12 of the tub 10, in any conventional manner. Although not shown, strainers, built-in or screwed-in stoppers or plugs may be used with the drain and drain pipe section 21 of the tub 10. Sequentially after the drain pipe section 21, there may be provided a trap section 22 and a pipe section 23 that will eventually reach any sewer network, septic tank, etc. The trap section 22 may be located farther away from the drain pipe section 21, and other components such as straight vertical pipes, etc., may also be used.

The drain pipe section 21 is a straight piece of pipe (e.g., cylindrical pipe) that features an opening 24 in its peripheral wall. Accordingly, an axis of the opening 24 is generally transverse to an axis of the drain pipe section 21, in similar fashion to a venturi arrangement. However, any other type of arrangement is considered as well, such as Y-shaped junction, etc. A pipe 25 (i.e., tube, tubing, conduit, rigid or flexible, etc) extends from the opening 24 to a drain unit 30. It is observed that the pipe 25 may have a trap section 26 in joining the drain pipe section 21 to the drain unit 30. It is also observed that the pipe 25 may have a diameter substantially smaller than that of the drain pipe section 21. The smaller diameter of the pipe 25 is sufficient considering that the volume of liquid drained by the pipe 25 is substantially smaller than the liquid drained via the pipe section 21. The relatively high dimensional ratio between the drain pipe section 21 and the pipe 25 also limits the volume of liquid that can backflow toward the drain hole 17 in the door sill 16.

Figure 3:
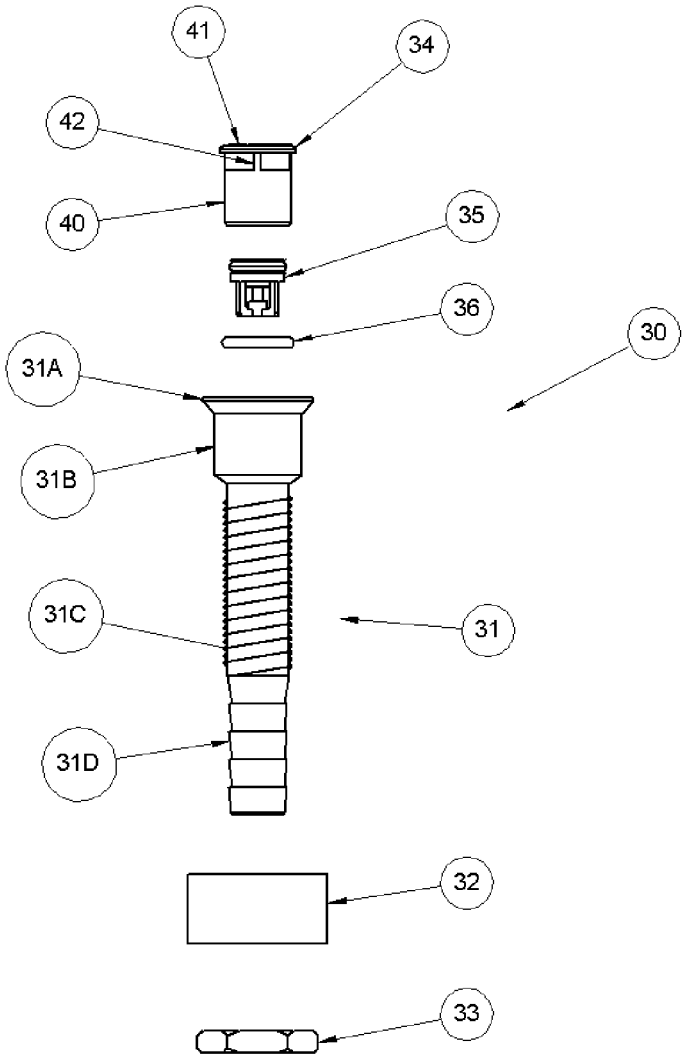
FIG. 3 is an exploded view of a drain unit of the drain system of FIG. 1.
Figure 5:
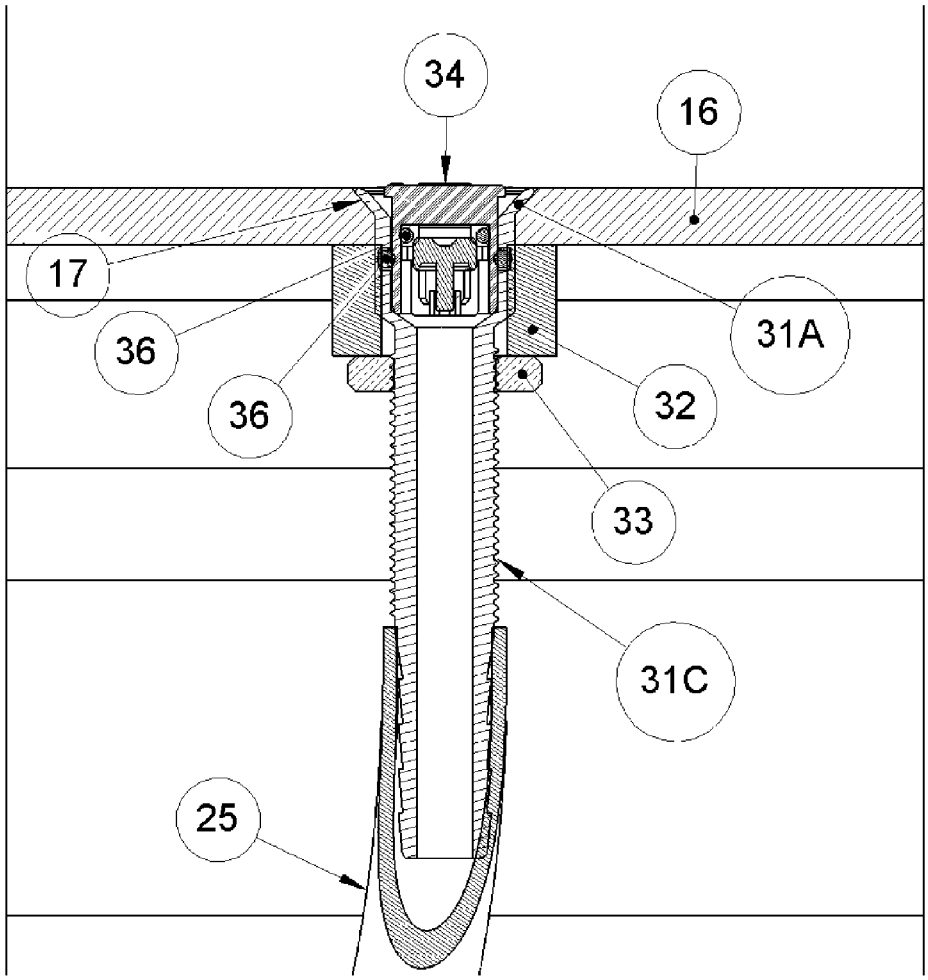
FIG. 5 is an enlarged section view of the drain unit of FIG. 3 as mounted to the door sill.

Referring concurrently to FIGS. 3 to 5, the drain unit 30 is shown having a pipe body 31 with a sequence of a flared edge 31A, an enlarged head 31B, a threaded section 31C and a fitting section 31D (for connection to pipe 25), sequentially from top to bottom. The flared edge 31A is shaped for complementary engagement in the counterbore shape of the drain hole 17. Moreover, the diameter of the drain hole 17 is essentially similar to that of the enlarged head 31B, to minimize any gap therebetween. As an alternative to a flared edge 31A, the pipe body 31 may have a flanged head, etc. Moreover, the threaded section 31C could also be of a same outer diameter as that of the enlarged head 31B. The fitting section 31D may comprise hose barb as in FIG. 3, to facilitate the connection of the pipe 25 (e.g., flexible pipe) to the pipe body 31. In yet another embodiment, there is no fitting section 31D, and an elbow fitting (not shown) is threadingly engaged (or connected in alternative manners) to the threaded section 31C. The elbow fitting in such an embodiment is the interface between the pipe body 31 and the pipe 25 and may therefore be equipped with hose bard or like connection means. The drain unit equipped with the elbow fitting may occupy a shorter volume than the drain unit with the straight fitting section 31D.

When the drain unit 30 is assembled to the door sill 16, a rubber washer 32 may be pressed against the hidden surface of the door sill 16, by the action of a nut 33 (e.g., hex nut, square nut) engaged on the threaded section 31C. The rubber washer 32 is for instance made of Dynaflex™ or of any other suitable polymeric sealing material. Additional washers such as metallic washers may be used as an option between the rubber washer 32 and the nut 33. The rubber washer 32 is tightly engaged on the enlarged head 31B to reduce the possibility of leakage therebetween. As the rubber washer 32 is pressed against the hidden surface of the door sill 16, the junction between washer 32 and hidden surface of the wall of the door sill 16 is waterproof if properly installed. Moreover, the pressure will be generally uniform if a resilient material, such as rubber or the like, is used. It is also considered to use other connection configurations to press the rubber washer 32 against the hidden surface of the tub wall, such as a clamp, a ratchet, etc. Moreover, the pipe body 31 may be sealingly mounted to the tub wall with other types of sealing configurations, such as add-on sealants (e.g., silicone), or a watertight solid joint by the precise mating of the pipe body 31 to the periphery of the drain hole 17.

Referring to FIGS. 3-5, the pipe body 31 has the enlarged head 31B sized to define an enlarged cavity to accommodate additional components. A check valve is fitted in the cavity of the enlarged head 31B. The check valve may comprise a drain cap 34 and a check valve member 35. The drain cap 34 is lodged in the opening of the pipe body 31, and thus acts as a strainer. Thus, the drain cap 34 is received at least partially and reliably secured in the enlarged head 31B, for instance by threading engagement, snap-fitting, or friction fitting. According to an embodiment, a seal 36 (e.g., O-ring) is in a groove of the cavity of the enlarged head 31B, and therefore seals any gap between the drain cap 34 and the inner surface of the enlarged head 31B, and holds the drain cap 34 captive in the cavity by applying biasing pressure thereon. This configuration provides sufficient forces to keep the check valve in the pipe body 31 despite a water pressure sustained by the check valve in case of a backflow (e.g., during draining of the tub) via the pipe 25, yet allows a user to manually pull the check valve out of the pipe body 31, for instance to remove waste (e.g., hair, soap scum, etc), from the exposed surface of the door sill 16.

The check valve member 35 is lodged between the drain cap 34 and a bottom of the inner cavity of the enlarged head 31B, and may be held captive in the enlarged head 31B by the drain cap 34. The check valve 35 is used to prevent any backflow through the pipe 25. The check valve 35 may be a floating piston, a spring-loaded piston, a floating ball, etc. In an embodiment, the check valve 35 is normally opened by the effect of gravity, and floats upwardly as a result of a backflow of water through the pipe 25. Hence, the check valve 35, normally opened, allows residual water collected from the drainage door sill 16 to reach the drain.

In very specific conditions, the flow of drainage water through the drain pipe section 21 may create a venturi effect via the opening 24, to create a suction at the drain hole 17. However, the drain unit 30 is preferably operative even if the drain pipe section 21 is plugged.

The O-ring 36 may also be inserted between the check valve 35 and the drain cap 34/inner cavity of the enlarged head 31B or between the drain cap 34 and the inner cavity of the enlarged head 31B to prevent water leakage therethrough in case of a backflow.

Referring to FIG. 3, the drain cap 34 is shown having a tubular body 40, a head 41, and arms 42 spacing the head 41 from the tubular body 40. The clearances between the arms 42 define the inlet for liquids to enter the tubular body 40. The head 41 esthetically covers the drain hole 17, and forms a strainer with the arms 42. The check valve member 35 may be releasably received in the tubular body 40, for instance with a seal therebetween as shown in FIG. 5).

As mentioned above, it is observed that the check valve is in close proximity to the drain hole 17 in the door sill 16. The check valve may therefore be manually removed, to clean the drain unit 30. If the drain system 20 has a drain cap 34, it may be pulled or rotated out of engagement with the pipe body 31, prior to the removal of the check valve member 35, or both parts may be removed concurrently. If the drain system 20 does not have a drain cap 34, the check valve member 35 may simply be pulled or rotated out of engagement with the pipe body 31. It is also observed that the drain unit 30 does not impede the closing of the door 14. Moreover, some form of vent may be allowed by a tolerance between drain hole 17 and door 14, to avoid creating air bubbles.

The invention claimed is:

1. A tub comprising:

a tub body defining a bathing cavity, and a doorway with door sill in the tub body;

a door mounted to the doorway and openable to access the bathing cavity;

a drain system comprising drain piping connected to a tub drain hole in a bottom of the bathing cavity for drainage of bathing liquid therethrough;

a drain unit connected to a door drain hole in the door sill for drainage of liquid therethrough, the drain unit having an inner cavity and a check valve held releasably captive in the inner cavity, the check valve being manually removable from an exposed surface of the door sill; and a pipe connecting the drain unit to the drain piping to direct liquid collected by the drain unit to the drain piping.

2. The tub according to claim 1, wherein the pipe defines a trap between the drain unit and the drain piping.

3. The tub according to claim 1, wherein an inner diameter of the pipe is substantially smaller than a diameter of the drain piping.

4. The tub according to claim 1, wherein the drain piping comprises a pipe section, and wherein the pipe is transversely connected to the pipe section.

5. The tub according to claim 4, wherein the pipe section comprises a radially projecting nipple for being connected to the pipe.

6. The tub according to claim 1, wherein the drain unit comprises a pipe body having an enlarged portion connected to a periphery of the door drain hole.

7. The tub according to claim 6, wherein the pipe body comprises a threaded section, with an annular seal surrounding the pipe body and a fastener engaged on the threaded section and pressing the annular seal against a hidden surface of the tub adjacent to the door drain hole.

8. The tub according to claim 1, further comprising an annular seal between the check valve and a surface of the inner cavity, the annular seal resiliently pressing against the check valve to hold same releasably captive in the inner cavity.

9. The tub according to claim 1, wherein the check valve comprises a drain cap and a check valve member operatively connected to the drain cap, the check valve member being held downwardly by gravity into a normally open position, and floating upwardly to a closed position.

10. The tub according to claim 9, wherein the drain cap comprises a strainer head located at the door drain hole.

11. A drain system for a tub of the type having a tub body defining a bathing cavity, a doorway with door sill in the tub body and a door in the doorway, the drain system comprising:

a drain piping section adapted to be in fluid communication with a tub drain hole in a bottom of the bathing cavity for drainage of bathing liquid therethrough;

a drain unit adapted to be connected to a door drain hole in the door sill for drainage of liquid therethrough, the drain unit having an inner cavity and a check valve held releasably captive in the inner cavity, the check valve being manually removable from an exposed surface of the door sill; and a pipe connecting the drain unit to the drain piping section to direct liquid collected by the drain unit to the drain piping section.

12. The drain system according to claim 11, wherein the pipe defines a trap between the drain unit and the drain piping section.

13. The drain system according to claim 11, wherein an inner diameter of the pipe is substantially smaller than a diameter of the drain piping section.

14. The drain system according to claim 11, wherein the pipe is transversely connected to the draining pipe section.

15. The drain system according to claim 14, wherein the draining pipe section comprises a radially projecting nipple for being connected to the pipe.

16. The drain system according to claim 11, wherein the drain unit comprises a pipe body having an enlarged portion connected to a periphery of the door drain hole.

17. The drain system according to claim 16, wherein the pipe body comprises a threaded section, with an annular seal surrounding the pipe body and a fastener engaged on the threaded section and pressing the annular seal against a hidden surface of the tub adjacent to the door drain hole.

18. The drain system according to claim 11, further comprising an annular seal between the check valve and a surface of the inner cavity, the annular seal resiliently pressing against the check valve to hold same releasably captive in the inner cavity.

19. The drain system according to claim 11, wherein the check valve comprises a drain cap and a check valve member operatively connected to the drain cap, the check valve member being held downwardly by gravity into a normally open position, and floating upwardly to a closed position.

20. The drain system according to claim 19, wherein the drain cap comprises a strainer head located at the door drain hole.

* * * * *